US006722813B2

(12) United States Patent
Hauer et al.

(10) Patent No.: US 6,722,813 B2
(45) Date of Patent: Apr. 20, 2004

(54) ROAD NETWORK DEVICE WITH ARTICULATED COVER

(75) Inventors: Jean-Claude Hauer, Saulxures lès Nancy (FR); Francis Berthon, Pompey (FR)

(73) Assignee: Saint-Gobain PAM, Nancy (FR)

( * ) Notice: Subject to any disclaimer, the term of this patent is extended or adjusted under 35 U.S.C. 154(b) by 0 days.

(21) Appl. No.: 10/070,163

(22) PCT Filed: Jun. 18, 2001

(86) PCT No.: PCT/FR01/01890

§ 371 (c)(1),
(2), (4) Date: May 22, 2002

(87) PCT Pub. No.: WO02/02878

PCT Pub. Date: Jan. 10, 2002

(65) Prior Publication Data

US 2002/0141820 A1 Oct. 3, 2002

(30) Foreign Application Priority Data

Jul. 6, 2000 (FR) ..... 00/08834

(51) Int. Cl.[7] ..... E02D 29/14
(52) U.S. Cl. ..... 404/25; 137/364; 52/19
(58) Field of Search ..... 404/25, 26; 52/19, 52/20; 137/364

(56) References Cited

U.S. PATENT DOCUMENTS 2,257,791 A * 10/1941 Edmister ..... 16/290
4,840,514 A * 6/1989 Defrance et al. ..... 404/25
4,892,221 A * 1/1990 Gora et al. ..... 220/826
5,017,039 A * 5/1991 Spiess et al. ..... 404/25
5,160,213 A * 11/1992 Spiess et al. ..... 404/25
5,324,135 A * 6/1994 Smith ..... 404/25
5,340,232 A * 8/1994 Spiess et al. ..... 404/25
5,628,152 A * 5/1997 Bowman ..... 52/20

FOREIGN PATENT DOCUMENTS

EP 0 420 777 A1 * 9/1990
EP 0 506 590 A1 * 9/1992
EP 0 506 591 B1 * 9/1992
EP 0 533 533 A1 * 3/1993

* cited by examiner

*Primary Examiner*—Gary S. Hartmann
(74) *Attorney, Agent, or Firm*—Sughrue Mion, PLLC

(57) ABSTRACT

A rigid anti-theft cover (3), for covering of shafts leading to underground mains-water systems, hingedly mounted on a frame (1) with two side edges (32A, 32B) bearing two projecting parts (30A, 30B) and engaging into two cells (10) of the frame which are at least partially overhung by a wall (13) of this frame to provide an axis of articulation parallel to a hinging border (31) of the cover. The cover also has an elastic finger (36) extending parallel to the side edges (32A, 32B) with a free end situated in proximity to the hinging border (31) and co-operating with a pressure lug (14) borne by the corresponding hinging edge (11) of the frame to permit, by elastic deformation of the finger (36) supported against the lug (14), positioning of the projecting parts (30A, 30B) into their respective cells (10) and their removal.

11 Claims, 7 Drawing Sheets

ROAD NETWORK DEVICE WITH ARTICULATED COVER

FIELD OF THE INVENTION

The invention relates to a public-road device with a hinged cover, in particular a cover constructed in the form of a grid. It applies in particular to devices for capping shafts for draining rainwater or to devices for closing manholes or shafts for inspecting underground mains-water systems, such as manholes in the roadway or pavement.

BACKGROUND OF THE INVENTION

For reasons of security, and for economic reasons, it is essential that the public-road devices cannot be removed except, where necessary, by competent personnel.

Public-road devices equipped to this end with a means preventing purely manual removal of the cover are already known.

In particular a device for capping access or drain shafts is known, comprising a frame and a cover consisting of a removable grid adapted for being hinged to the frame about an axis extending in the vicinity of one side of the grid, this grid being composed, in the direction of its pivotal axis, of a median part and two side parts bearing parts projecting into seats on the frame which are elastically linked to the median part, conferring upon it an overall deformable structure. The deformability of the framework of the grid is put to advantage in that it is also provided with one or more similarly elastically deformable bars for engaging with snap-fit lugs borne on the frame, in order to prevent all purely manual opening of the manhole allowing the grid to be removed. However, as a result of the overall deformable structure of the grid, removal of the latter remains possible by pinching the two side bars furthest out so as to release their projecting parts from their seat in the frame, by means of makeshift levers.

Anti-theft devices based on the use of an attachment to prevent removal of the cover are similarly known; this is also a disadvantage, because this attachment can be removed by means of a conventional tool and lost.

SUMMARY OF THE INVENTION

The object of the invention is to resolve these disadvantages, and to this end relates to a public-road device consisting of a rigid cover hingeably mounted on a frame, the cover comprising two side edges bearing two projecting parts defining an axis of articulation parallel to a hinging border of the cover and engaging with two corresponding cells of the frame at least partially overhung by a wall of the frame, characterised in that the cover also comprises an elastically deformable finger extending parallel to the side edges; the free end of this finger is situated in proximity to the hinging border and is adapted to cooperate with a pressure lug borne by the corresponding hinging edge of the frame in order to permit, by elastic deformation of the finger supported against the lug, positioning of the projecting parts into their respective cells and their removal from them.

Due to this structure, malicious removal and in particular theft of the cover is made difficult, for removal necessitates recourse to a special tool such as a jumper bar or pick-axe.

The public-road device according to the invention may also exhibit one or more of the following characteristics:

The pressure lug has an upper side surface which slopes upwards, and an overhanging lower side surface which, in the closed position of the cover on the frame, co-operates with a corresponding sloping surface of the free end of the elastically flexible finger;

Opposite the lug, the frame exhibits a second pressure lug borne by an end border opposite the hinging border and adapted to co-operate by entering into a snap-fit relationship with the free end of a second flexibly elastic finger borne by the cover;

The second pressure lug and the free end of the second elastically flexible finger have co-operating surfaces forming cams, active in the direction of opening and/or closing of the cover;

The free end of each elastically flexible finger has a recess for a side region of the lug;

The elastically flexible fingers extend perpendicularly to the direction of extent of the hinging projecting parts;

The elastically flexible fingers extend into respective notches of the cover, the free end of each finger terminating in a space manufactured in the corresponding border of the cover;

The cover is a grid;

The cover is made of ductile cast iron; and

The cover is of a generally quadrilateral shape.

BRIEF DESCRIPTION OF THE DRAWINGS

Other characteristics and advantages of the invention will emerge from the following description, embodiments of the invention given by way of non-limiting examples and illustrated by the attached drawings.

DETAILED DESCRIPTION OF THE EXEMPLARY EMBODIMENTS

Figure 1:
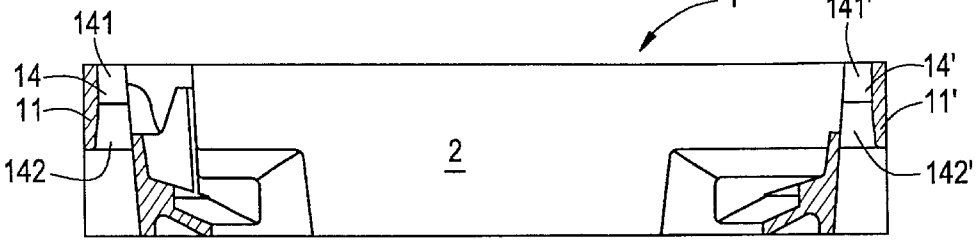
FIG. 1: A diagrammatic section along the line I—I in FIG. 2 of a frame of the same structure as a first embodiment of a device in public roads according to the invention.
Figure 2:
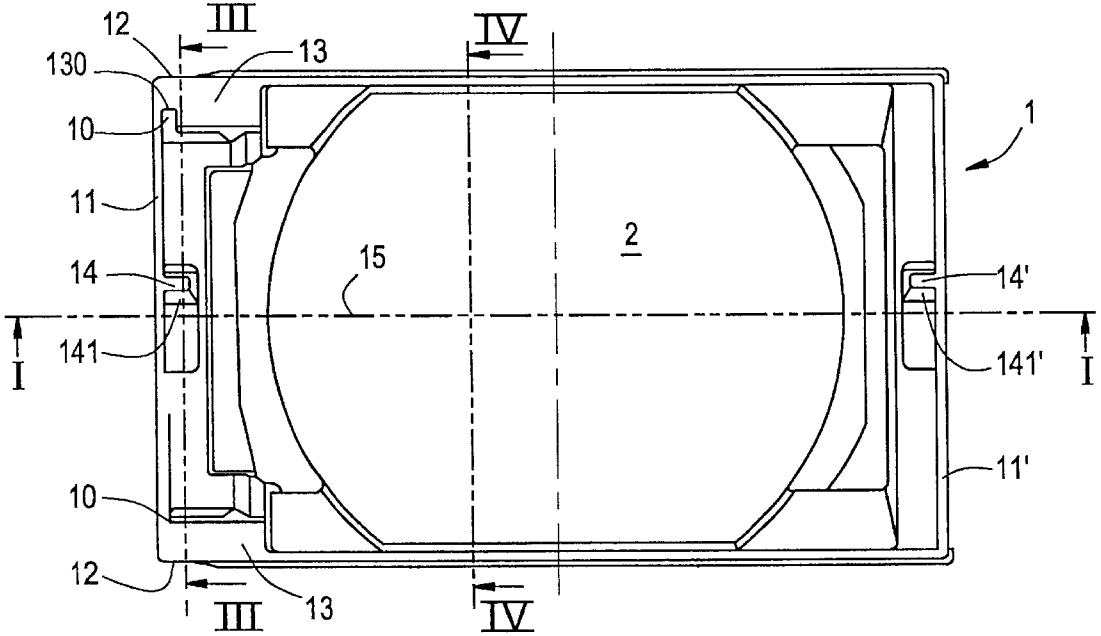
FIG. 2: A diagrammatic top view of the frame represented in section in FIG. 1.
Figure 4:
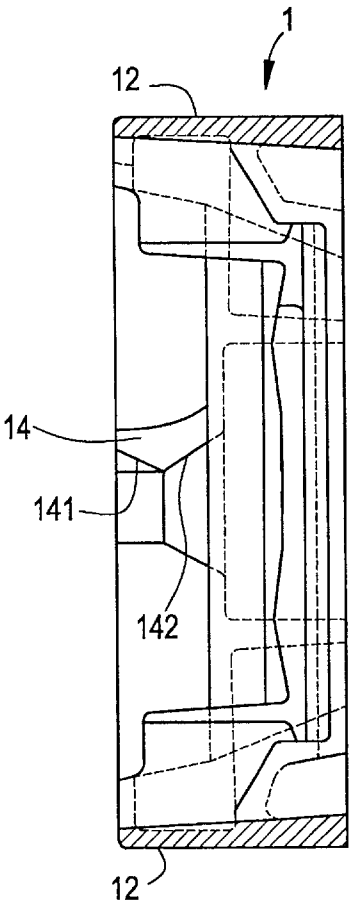
FIG. 4: A diagrammatic section of the frame in FIG. 2 along line IV—IV of this figure.
Figure 3:
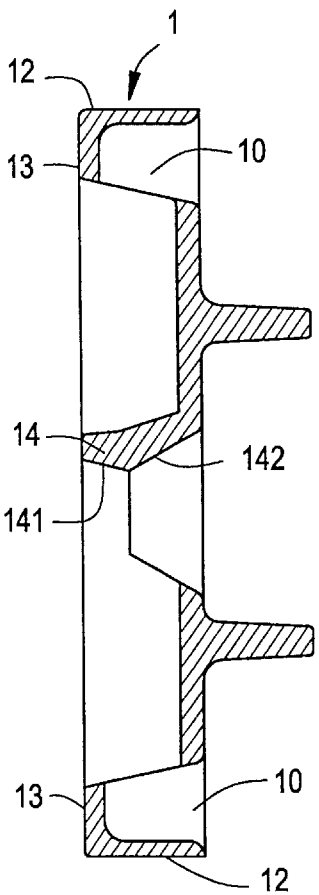
FIG. 3: A diagrammatic section of the frame in FIG. 2 along line III—III in this figure.
Figure 5:
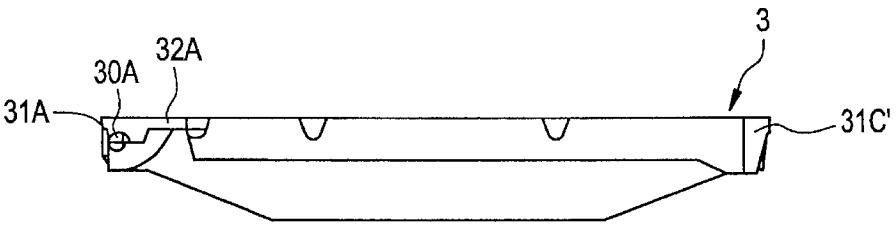
FIG. 5: A diagrammatic front view of a cover of the same structure as the first embodiment of a public-road device according to the invention.

The public-road device illustrated in the figures is a capping device for a drainage system, intended to be fixed in the ground, for example in a road surface, at the top end of a drainage or access shaft (not shown); here this device is a quadrilateral, but this shape is of course non-limiting.

The device is composed of two pieces made of ductile cast iron, namely a frame 1, here of general rectangular shape, delimiting an access 2, here circular, to the shaft, and a rigid grid 3 forming a sealing cover for the frame. The cover 3 and the frame 1 are hinged to one another by mutual articulation means in such a way that the cover can be moved between a closed position in which it rests on the frame and approximately covers the access, and an open position in which it substantially frees it, more precisely in an approximately pivotal motion about an approximately horizontal axis parallel to the short sides of the rectangle of the device while resting in the frame between the two positions mentioned above.

Here, the word "horizontal" means (and will mean throughout the text) "parallel to the plane in which the frame extends", although this plane may possibly be inclined if the device is intended to be embedded in the surface of sloping ground, and the word "vertical" will mean "perpendicular to the plane in which the frame extends".

The mutual articulation means of the cover 3 and of the frame 1 are respectively two parts 30A, 30B projecting sideways respectively on one of the two side of the cover, borne by the two side edges in proximity to an end border 31 hereinafter called the "hinging border" of the latter, these two projecting parts being axially aligned with each other to define the approximately horizontal pivotal axis of the cover, and two cells 10 of the frame adapted for respectively accommodating these two projecting parts of the cover.

The cells 10 of the frame are bordered by an end edge 11 and side edges 12 of the frame which belong to the outer wall of the latter, the end edge 11 being intended to accommodate the hinging border 31 of the cover so that they face one another, the projecting parts 30A, 30B being positioned in proximity to the said hinging border 31; this end edge 11 of the frame serves as a limit stop for the cover 3 to define a stopped-open position of the latter.

The two cells 10 are overhung by a wall 13, the upper face of which is co-planar with the upper face of the frame, that is, the upper boundary of the outer wall of the latter, and approximately with the upper face of the cover 3 when the latter is in a closed position; for one of the cells, the overhanging wall 13 has a notch 130, the function of which will be mentioned below, while in the case of the other cell, the wall 13 without discontinuity adjoins the end edge 11 of the frame and thus constitutes a solid bridge over the latter.

The end edge 11 and the opposite end edge 11' of the frame are each provided with a pressure lug 14, 14' for the cover 3, extending towards the interior of the frame, the upper face of which is co-planar with the upper boundary of the edge 11, 11'; the two lugs 14, 14' are arranged opposite one another, on the same side of the median line 15 of the frame 1, i.e. on the side where the overhanging wall 13 presents a notch 130, a few millimeters from this median line; in its upper part each lug consists of sloping side surfaces converging towards one another in the direction of its upper surface, the side surface 141, 141' of each lug situated near the median line 15 being intended to constitute a surface pushing against a flexible element of the cover, as will be seen later on; in their lower part, these two pins similarly comprise sloping side surfaces, and in particular a side surface 142, 142' situated on the side of the median line of the frame and moving away from this median line while moving towards the lower face of the lug, intended to constitute a pressure surface similarly acting on the flexible element of the cover, under circumstances which will similarly be explained further on.

For greater convenience, the terms such as "high", "low", "upper", "lower", "above", "below", used to define certain elements of the cover 3, will refer to the position of these members when the cover is in the closed position.

The grid constituting the cover 3 is formed as a single piece of an approximately rectangular general shape, of longitudinal bars extending perpendicularly to its axis of articulation, and of transverse bars extending parallel to the axis, these bars delimiting windows passing right through the thickness of the cover in such a way that the latter is light while having a rigid framework.

Figure 6:
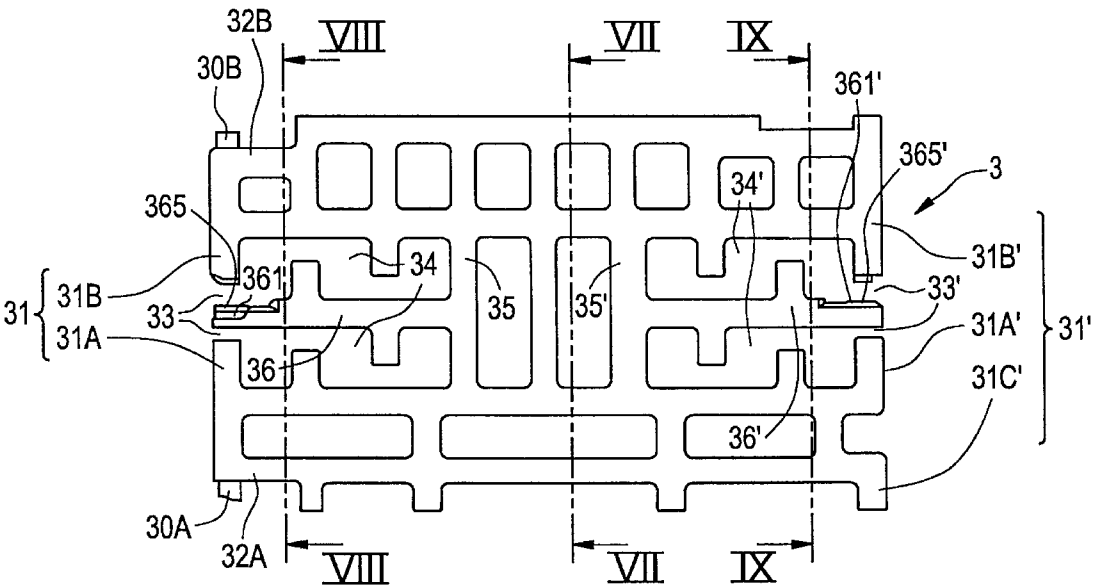
FIG. 6: A diagrammatic top view of the cover in FIG. 5.
Figure 9:
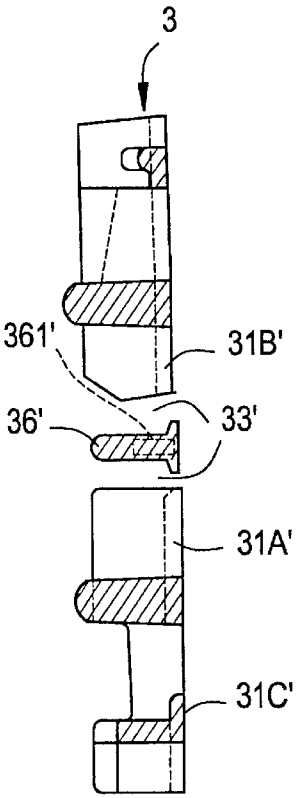
FIG. 9: A diagrammatic section of the cover in FIG. 6 along the line IX—IX in this figure.
Figure 8:
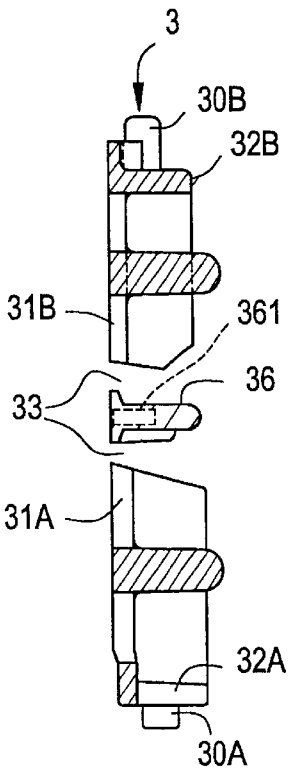
FIG. 8: A diagrammatic section of the cover in FIG. 6 along line VIII—VIII in this figure.
Figure 7:
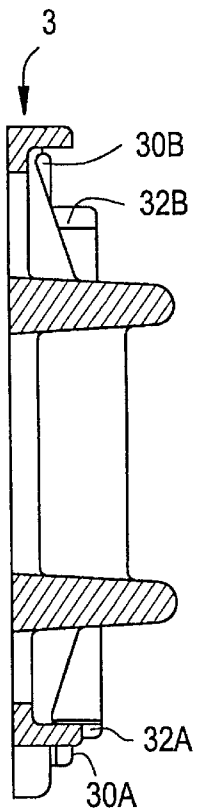
FIG. 7: A diagrammatic section of the cover in FIG. 6 along line VII—VII in this figure.
Figure 10:
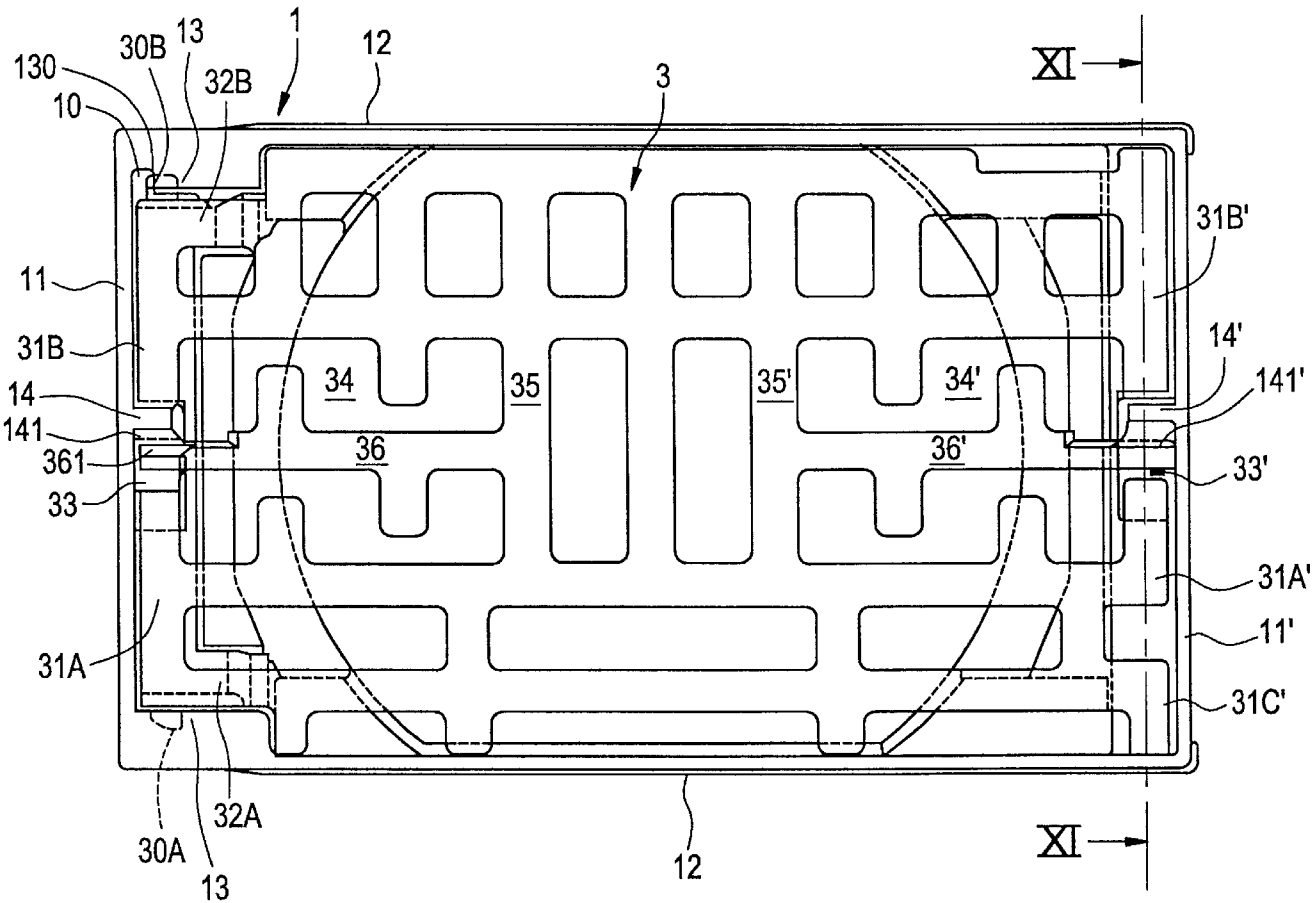
FIG. 10: A diagrammatic top view of the public-road device according to the first embodiment.
Figure 11A:
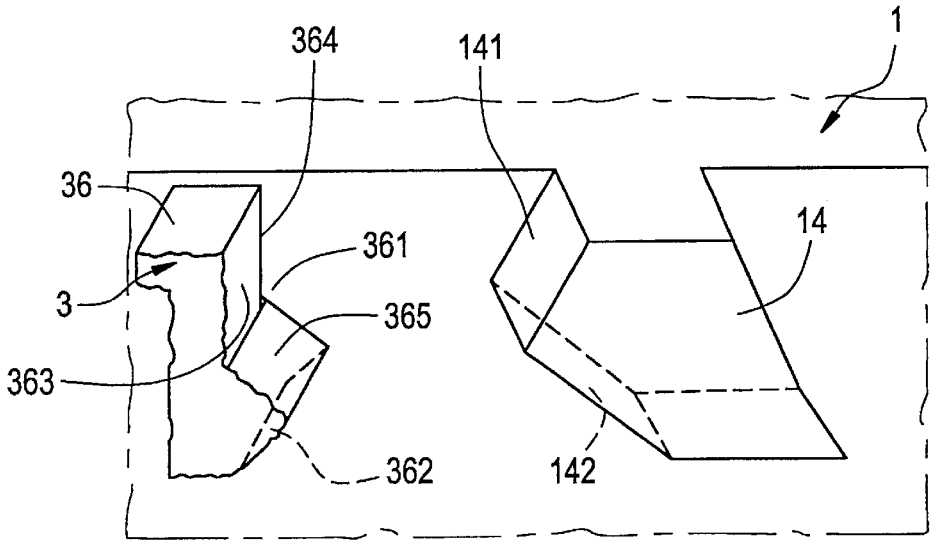
FIG. 11A is a diagrammatic perspective view of a lug of the frame in FIGS. 1 to 4, and of the free end of a flexible finger of the cover in FIGS. 5 to 9 adapted so as to be in a snap-fit relationship with one another in the closed position of the cover but shown at a distance from one another to clarify the drawing.
Figure 11B:
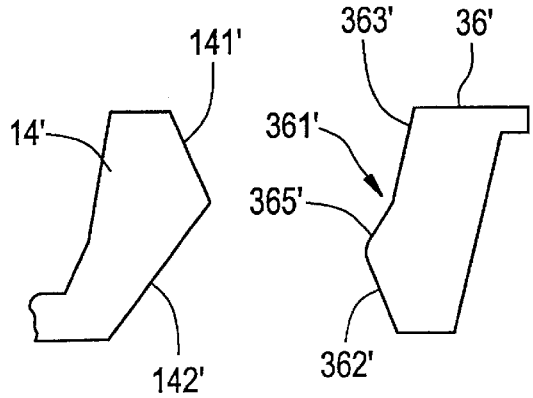
FIG. 11B is a diagrammatic transverse section of another lug of the frame in FIGS. 1 to 4 and of another flexible finger of the cover in FIGS. 5 to 9 adapted so as to be in a snap-fit relationship with one another in the closed position of the cover but, to clarify the drawing, shown at a distance from one another in the vicinity of line XI—XI in FIG. 10.

The regions of longitudinal bars 32A, 32B comprising the structure of the side edges of the grid 3 bearing the projecting parts 30A, 30B are shaped in section like a backward-facing L, the horizontal arm of which extends towards the upper part of the grid, and the free end of the vertical arm of which is in the lower part of the grid; the horizontal arms of the backward-facing Ls of these two bars 32A, 32B extend in the same direction, and thus the vertical arm of the backward-facing L of one of the bars 32A defines a side boundary of the grid, while the opposite side boundary is defined by the free end of the horizontal arm of the backward-facing L of the other bar 32B, the vertical arm of which is recessed relative to this side boundary; as the two projecting parts 30A, 30B extend beyond the contour of the grid over approximately the same length, the projecting part 30A borne by the first bar 32A is shorter than the projecting part 30B borne by the second bar 32B (see FIGS. 7 and 8); to make it easier to place in position, the shorter projecting part 30A is furthermore chamfered or truncated so as to present a further shortened region on the nearest side of the end edge of the grid (see FIG. 6).

The end border 31 of the grid in proximity to which the projecting parts 30A, 30B are positioned (hinging border) is composed of two aligned portions, here two portions 31A, 31B, extending longitudinally to form this edge, separated by a space 33 extending over an approximately equal distance on the two sides of the median line 15 of the frame 1 when the grid 3 is inserted into it in the closed position. This space 33 is extended by a notch 34 extending in the direction of the central region of the grid, the base of which is formed by a transverse bar 35 parallel to the hinging border 31; this notch 34, which is wider than the space 33, extends on both sides of the median line 15.

The transverse bar 35 belonging to the rigid framework bears, integrally with it, an elastically flexible finger 36 extending in the notch approximately the length of the median line 15 of the frame when the grid is in the closed position, that is, perpendicularly to the axis of articulation approximately from the vicinity of the transverse bar 35 as far as into the space 33 between the two portions 31A, 31B and at a distance from them, the region of the free end of the flexible finger 36 being situated approximately equally distant from these two portions. With this geometry and the proximity of the lug 14 and of the median line 15, it would be impossible to embed the grid 3 in the closed position within the frame 1 if these two items did not have not have suitable fittings; more precisely, the surface of the free end region of the finger which is coplanar with the upper face of the grid has a wide recess 361 opening into this upper face on the side of the portion 31B close to the longer projecting part 30B; this recess 361 constitutes a seat for the side region of the lug 14 of the frame situated near the median line 15, when the grid is in the closed position in the frame; the side surface of the same region of the finger 36 extending below the level of the recess 361 defines a crest in the shape of an inverted V pointing opposite the portion 31B, composed of a sloping upper surface 365 and an overhanging lower surface 362. A substantially vertical surface 363 links the sloping surface 365 to the upper face of the grid.

The end border 31' of the grid opposite and approximately parallel with the hinging border 31 is also composed of portions, here of three portions 31A', 31B', 31C' extending longitudinally to form this border, two portions 31A', 31B' of which are separated by a space 33' extending over an approximately equal distance on both side of the median line 15 of the frame when the grid 3 has been inserted into it in the closed position.

This space 33' is similarly extended by a notch 34' extending in the direction of the central region of the grid, the base of which consists of a transverse bar 35' parallel to the end border 31'; this notch 34', which is wider than the space 33', extends on both sides of the median line 15.

The transverse bar 35' of the rigid framework bears, integrally with it, a finger 36' for locking the cover in a closed position, similarly elastically flexible, extending in the notch approximately the length of the median line 15 of the frame when the grid is in the closed position, that is, perpendicularly to the axis of articulation approximately from the middle of the transverse bar 35' as far as into the space 33' between the two portions 31A' and 31B' and at a distance from them, the region of the free end of the flexible finger 36' being situated approximately equally distant from these two portions. As, with this geometry, it would be impossible to embed the grid 3 in the closed position in the frame 1 if these two items did not have not have suitable fittings, the surface of the free-end region of the finger 36' co-planar with the upper surface of the grid has a recess 361' opening into this upper surface and on the side of the portion 31B' which is itself on the side of the longer projecting part 30B; this recess 361' constitutes a seat for the side region of the lug 14' of the frame situated on the side of the median line 15, when the grid is in the closed position in the frame; the side surface of the same region of the finger 36' extending below the level of the recess 361' defines a crest in the shape of an inverted V pointing opposite the portion 31B' and constitutes a bearing surface adapted to receive, at the time of insertion of the end border 31' of the grid in the frame opposite the end edge 11' of the latter, a force from the side surface 141' of the lug 14' inducing elastic deformation of the finger and, at the time of disengagement of the end border 31', a force from the side surface 142' similarly inducing elastic deformation of the finger. This inverted V-shaped crest is made up of an upper sloping surface 365' and an overhanging lower surface 362', a substantially vertical face 363' linking the upper surface 365' to the upper face of the grid.

The operations involved in mounting the grid 3 in the frame 1, in closing the device, in removing the grid and in locking the grid and, as they come to be put into operation, certain parts of the frame and of the grid and more particularly of the lugs 14, 14' and fingers 36, 36' which permit these operations.

For mounting the two projecting parts 30A, 30B into the cells 10 of the frame 1, the procedure is as follows:

The grid 3 is positioned at 90° relative to the frame, slightly askew in order to be able to introduce the longer projecting part 30B in the corresponding cell 10; in this position, an end stop 364 of the substantially vertical face 363 of the flexible finger 36 comes into contact with the sloping side surface 141 of the pressure lug 14 of the frame, while the chamfer of the projecting part 30A comes into contact with the vertical boundary of the wall 13 situated on the side of the projecting part 30A; thus, all additional translation of the grid in the direction of the wall 13 situated on the side of the projecting part 30B, necessary for introducing the projecting part 30A into its cell 10, is rendered impossible; in this position, the horizontal arm of the backward-facing L of the bar 32B is opposite the notch 130 made in the wall 13 on the side of the projecting part 30B;

A force in the direction of top to bottom is then exerted on the grid 3, thus permitting the chamfer of the projecting part 30A to slide over the vertical boundary of the wall 13, inducing displacement of the grid transversely while at the same time bending the finger 36; on the side of the projecting part 30B, the horizontal arm of the backward-facing L of the bar 32B penetrates into the notch 130 of the wall 13, the thickness of this arm being less than the width of the notch;

When the projecting part 30A escapes from the vertical boundary of the wall 13, the finger 36 returns to the free state and thus returns the projecting part 30A into the corresponding cell 10, this transverse displacement of the grid similarly inducing its removal from the notch 130 in the wall 13. In this vertical position in which the projecting parts are inserted into the cells, the grid is subject to slight transverse play the amplitude of which does not permit one or the other of the projecting parts to escape, rendering the grid impossible to remove from the frame without suitable tools, the elastic finger 36 thus providing an anti-theft function.

When the grid is closed, the free end of the flexible finger 36 passes beneath the pressure lug 14 and the sloping surface 365 of the finger comes alongside the sloping side surface 142 of the lug 14 from beneath to constrain the flexible finger 36, a second function of which consists in keeping the hinging border 31 of the grid in contact with the frame 1. To this end, the slope of the surface 365 corresponds to that of the surface 142.

In the closed position, this co-operation between the surfaces 365 and 142 thus enables the grid to be fixed firmly to the frame. It will also be noted that the surfaces 141 and 142 of the pin 14 have gradients typically of the order of 20° and 30° respectively relative to the vertical.

The grid 3 is removed as follows:

The grid is placed in the 90° open position;

A tool (jumper bar or pick-axe) is placed in proximity to the projecting part 30A, between the grid and the inner face of the side edge 12 of the frame;

Pressure is exerted so as to displace (translate) the grid by bending the flexible finger 36 the vertical face 363 of which comes into contact with the crest formed by the sloping side surfaces 141 and 142 of the pressure lug 14 until bending of the finger 36 is sufficient for it to be possible to extract the projecting part 30A from its cell;

Finally, the grid is translated in the opposite direction to release the longer projecting part 30B.

To lock the grid 3 in the closed position and thus prevent it from being raised in the direction of opening, the second flexible finger 36' is used, situated opposite the hinge and adapted to co-operate with the second pressure lug 14' of the frame in a snap-fit relationship.

As has already been seen, the pressure lug 14' has a convex shape like an inverted V with a surface forming an upturned upper slope 141', and a surface forming a lower, overhanging slope 142'. The surface 141' is preferably less inclined from the vertical than the surface 142', typical gradient values being of the order of 20° and 30° respectively. The same applies to the surfaces forming co-operating slopes 365' and 362' belonging to the flexible finger 36' which similarly have a convex shape like an inverted V, the upper face 365' having the same gradient as the lower face 142 of the lug 14', while the lower surface 362' of the finger 36' has the same gradient as the upper surface 141' of the lug 14'.

Thus, to lock the grid 3 on to the frame 1 the latter is rocked in the direction of closure, possibly by exerting a blow on to it; co-operation of the surfaces 362' and 141' elastically pushes back the finger 36' then, after clearing the apex of the V, the finger 36' returns elastically towards its original position. The grid is then locked by co-operation of the surface 365' of the finger 36' with the lower surface 142' of the lug 14'.

This co-operation opposes opening of the grid without a special tool, and fixes the grid firmly on the frame.

To open the grid (unlocking), a tool (for example a jumper bar or pick-axe) is inserted between the grid and the frame in a region at a distance from the hinge, especially at the level of the end border 31' or at the level of the side edges 12 in proximity to the border 31'; then, leaning against the frame, one exerts a rocking action in the opening direction.

Actuated by the cam, the upper surface 365' of the finger 36' then slides along the inner surface 142' of the lug 14', the finger 36' bending elastically until it is released from being retained by the pressure lug 14'. In the final unlocked position, the finger 36' is elastically returned to a resting position.

The flexible finger 36' thus ensures automatic locking and unlocking of the grid 3 without it being necessary to act directly upon the latter, which would risk damaging it.

Notably, the surface 362 of the finger 36 therefore plays no active role, and that the surface 142 of the pressure lug 14 is not involved when the grid is being mounted or removed; on the other hand, in co-operation with the sloping surface 365 of the finger 36, this surface enables the grid to be fixed firmly on the frame in a closed position of the grid.

Figure 12:
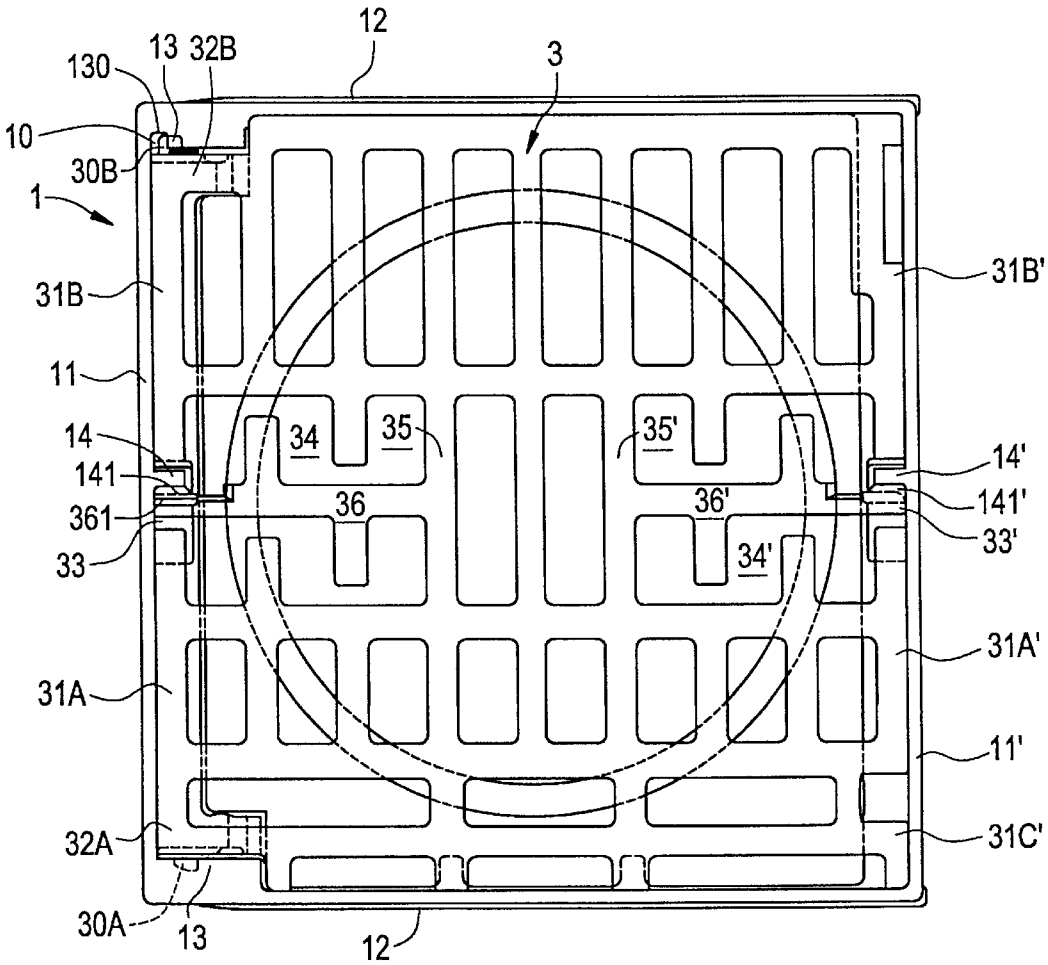
FIG. 12 is a diagrammatic top view of a public-road device according to a second embodiment.

FIG. 12 shows a variant embodiment of a public-road device according to the invention, in which the device has an approximately square general shape. As the differences between this public-road device and that of the preceding figures consists in that the general shape is square, not rectangular, and that the geometry of the grid 3 is only slightly different as a result of this square shape, the device in FIG. 12 will not be described in detail; the visible members in FIG. 12 that have already been described with reference to FIGS. 1 to 11 carry the same reference numbers.

However, the invention is of course not limited to these embodiments, and others can be envisaged without exceeding its scope; in particular it will be possible to envisage embodiments in which the cover is not in the form of a grid and forms in which a plurality of spaces are provided all along the same edge of the cover and are extended by a notch in which an elastically flexible finger extends. In particular it will be possible to envisage embodiments in which the cover is a cushioned lid and possesses at least one flexible finger on the under-surface, that is, extending beneath the lower face, co-operating with at least one lug of the frame offset downwards as compared with the embodiments described above.

What is claimed is:

1. A public-road device consisting of:

a rigid cover (3) hingeably mounted on a frame (1), the cover (3) comprising two side edges (32A, 32B) bearing two projecting parts (30A, 30B) engaging into two corresponding cells of the frame which are at least partially overhung by a wall (13) of the frame, wherein:

the projecting parts define an axis of articulation parallel to a hinging border (31) of the cover;

the cover (3) also comprises an elastically flexible finger (36) extending parallel to the side edges (32A, 32B);

the free end of the finger (36) is situated in proximity to the hinging border (31) and is adapted to co-operate with a pressure lug (14) arranged on the corresponding hinging edge (11) of the frame in order to permit, by elastic deformation of the finger (36) supported against the lug (14), positioning of the projecting parts (30A, 30B) into their respective cells (10) and their removal from the latter.

2. A public-road device according to claim 1, wherein:

the pressure lug (14) comprises an upper side surface (141) which slopes upwards, and an overhanging lower side surface (142); and when the cover (3) is in a closed position on the frame (1), the overhanging lower side surface (142) co-operates with a corresponding sloping surface (365) arranged on the free end of the elastically flexible finger (36).

3. A public-road device according to claim 1, wherein:

the frame (1) comprises, opposite the lug (14), a second pressure lug (14') arranged on an end border (31') opposite the hinging border (31); and the second pressure lug (14') is arranged to enter into a snap-fit relationship with a free end of a second flexibly elastic finger (36') arranged on the cover (3).

4. A public-road device according to claim 3, wherein:

the second pressure lug (14') and the free end of the second elastically flexible finger (36') have co-operating surfaces (141', 142', 365', 362') forming cams, active in a direction of opening and/or closing of the cover.

5. A public-road device according to claim 3, wherein:

the free end of each elastically flexible finger (36, 36') has a recess (361, 361'for a side region of the lug (14, 14').

6. A public-road device according to claim 3, wherein:

the elastically flexible fingers (36, 36') extend perpendicularly to the direction of extent of the hinging projecting parts (30A, 30B).

7. A public-road device according to claim 3, wherein:

the elastically flexible fingers (36, 36') extend into respective notches (34, 34') of the cover (3), the free end of each finger terminating in a space (33, 33') manufactured in the corresponding border (31, 31') of the cover.

8. A public-road device according to claim 1, wherein:

the cover (3) is a grid.

9. A public-road device according to claim 1, wherein:

the cover (3) is made of ductile cast iron.

10. A public-road device according to claim 1, wherein:

the cover (3) is of a generally quadrilateral shape.

11. A public-road device according to claim 1, wherein:

the elasticity of the finger (36) is set to a large enough value that a separate tool must be used to remove the cover (3) from the frame (1).

* * * * *